US011603300B2

(12) United States Patent
Calomino et al.

(10) Patent No.: US 11,603,300 B2
(45) Date of Patent: Mar. 14, 2023

(54) APPARATUS FOR HANDLING HEAVY COMPONENTS ON CONTAINERS

(71) Applicant: GREENFIELD PRODUCTS, LLC, Hazel Crest, IL (US)

(72) Inventors: Anthony Calomino, Chicago, IL (US); William Healy, Wheaton, IL (US)

(73) Assignee: Greenfield Products, Inc., Hazel Crest, IL (US)

( * ) Notice: Subject to any disclaimer, the term of this patent is extended or adjusted under 35 U.S.C. 154(b) by 101 days.

(21) Appl. No.: 17/169,081

(22) Filed: Feb. 5, 2021

(65) Prior Publication Data

US 2021/0163275 A1 Jun. 3, 2021

Related U.S. Application Data

(62) Division of application No. 16/380,704, filed on Apr. 10, 2019, now Pat. No. 10,919,748.

(60) Provisional application No. 62/655,876, filed on Apr. 11, 2018.

(51) Int. Cl.
*B66F 9/12* (2006.01)
*B66F 9/08* (2006.01)

(52) U.S. Cl.
CPC . *B66F 9/12* (2013.01); *B66F 9/08* (2013.01)

(58) Field of Classification Search
CPC ..... B66F 9/12; B66F 9/08; B66F 9/07559; B66F 9/07481; B66F 9/0759; B66F 9/10; B66F 9/105; B66F 9/127; B66F 9/122; B60P 1/022
USPC ..... 414/667
See application file for complete search history.

(56) References Cited

U.S. PATENT DOCUMENTS

| | | | | |
|---|---|---|---|---|
| 3,187,917 A * | 6/1965 | Miller | B66F 9/06 | 414/664 |
| 5,391,043 A * | 2/1995 | Bohata | B66F 9/19 | 414/544 |
| 5,879,124 A * | 3/1999 | Brouwer | B66F 9/10 | 180/209 |
| 2008/0095578 A1* | 4/2008 | Farber | B66F 9/08 | 405/3 |
| 2011/0091306 A1* | 4/2011 | Roux | B66F 9/08 | 414/667 |
| 2011/0243699 A1* | 10/2011 | Kleeberger | B66F 9/148 | 414/667 |

(Continued)

*Primary Examiner* — Glenn F Myers
(74) *Attorney, Agent, or Firm* — McCracken & Gillen LLC

(57) ABSTRACT

A machine for handling heavy components in a heavy equipment environment. In an example implementation, the machine includes a truck having at least two front wheels and at least one rear wheel. A outrigger portion extends forward from the truck. The front wheels are attached at a forward end of the outrigger portion. A mast extends vertically from a track extending forward from the truck on a base of the outrigger portion. The mast is movably extendable or retractable along the track. A carriage is mounted on the mast and configured to move vertically on the mast. A pair of forks are mounted on the carriage to move vertically when the carriage is controlled to move. A personnel platform is mounted on the carriage independent of the mounting of the forks on the carriage. A remote control panel is configured to override a cab control panel under operator control. The remote control panel includes a plurality of controls for moving the carriage and for extending or retracting the mast.

20 Claims, 10 Drawing Sheets

(56) References Cited

U.S. PATENT DOCUMENTS

| | | | | |
|---|---|---|---|---|
| 2013/0183127 | A1* | 7/2013 | Dammeyer | B66F 9/10<br>414/592 |
| 2017/0129753 | A1* | 5/2017 | Kraimer | B66F 9/08 |

* cited by examiner

APPARATUS FOR HANDLING HEAVY COMPONENTS ON CONTAINERS

CROSS-REFERENCE TO RELATED APPLICATIONS AND CLAIM OF PRIORITY

The present application is a divisional application of Calomino et al., U.S. patent application Ser. No. 16/380,704, filed Apr. 10, 2019, entitled "Apparatus for Handling Heavy Components on Containers," which claims the benefit of Calomino et al., U.S. Provisional Application No. 62/655,876, filed Apr. 11, 2018, entitled "Apparatus for Handling Heavy Components on Containers." The entire contents of these applications are incorporated herein by reference.

FIELD OF DISCLOSURE

The present invention relates to methods and apparatuses for handling large, heavy components for shipping containers, and more particularly, for handling equipment such as generator sets to be installed on refrigerated containers or removed therefrom for storage.

BACKGROUND

A common task performed in port facilities involves installing and removing generator sets from refrigeration units on shipping containers. The shipping containers are typically large boxes having a size and space comparable to a room in a building. The containers may be moved from one location to another in the facility, or to and from a ship, using a crane. Shipping containers may also include large trailers that attach to semi-trucks. The containers are used to ship large cargo, such as automobiles, or smaller cargo such a smaller objects or material in bulk. Some cargo, such as fruits and proteins (e.g. meat, fish, etc.), must be refrigerated during shipping, and for such shipments, the containers may be fitted with a refrigeration unit. Over 1,000,000 refrigerated containers (also known as "Reefers") are in use today.

The refrigeration units on shipping containers require electrical power to operate. The typical source of electrical power for refrigeration units is the generator set, which is a fuel powered motor configured to drive an electrical generator. Generator sets, or gen-sets, are large, bulky and heavy pieces of equipment that are also detachable for storage when not needed for refrigerating a container. That is, the containers are not required to carry the extra load of the generator set if its load need not be refrigerated. The generator sets are also removable for service.

The generator sets are attached to the containers using a forklift and at least two or more workers, which may include a forklift operator and one or more installers (either attaching or removing the generator set). The forklift operator is required to operate and stay in the forklift to man the forklift controls. When attaching a generator set to a container, the forklift operator retrieves the generator set from a storage location and moves the generator set to a side of the container on which the generator set is to be mounted. The forklift may include a personnel platform mounted on the forks of the forklift, where the forks extend from the personnel platform a length sufficient to hold the generator set. The personnel platform is used to hold a worker, an installer, for example, during attachment of the generator set to the container. With one of the workers in the platform, the forklift operator lifts the generator set to the attachment level on the container. The forklift operator may then need to move the generator set closer to the container at the attachment level with the worker in the platform. Once the generator set is in position, the installer attaches the generator set using tools, such as wrenches or other tools, some of which may be power tools. Once the generator set is attached, the forklift operator moves the platform away from the container with the installer in the platform and lowers the platform to allow the installer to step off the platform. In detaching the generator set, the reverse process is followed.

If a forklift with no personnel platform is used to attach the generator set, the operation may require up to three workers to attach the generator set. As in the example described above, the forklift operator must stay in the forklift to man the forklift controls. An installer mounts a ladder or other suitable personnel elevating equipment to perform any attachment or component connection functions at the level at which the generator set is mounted to the container. A second installer may be used, either on another ladder to work at the generator set mounting level, or under the generator set, during attachment to perform any attachment or component connection functions at or under the generator set mounting level.

The need to use up to three workers to attach (or detach) a generator set to (or from) a container is both wasteful and potentially unsafe. Furthermore, the procedures for attaching and/or detaching the generator sets from a container potentially involve violations of OSHA/ANSI safety standards. For example, in procedures using a personnel platform, the forklift must typically be moved horizontally while a worker is in the platform, which can be an OSHA/ANSI violation. In addition, OSHA B56.1 (2012) allows the practice of mounting a personnel platform on the forks, but this must be specifically approved by the forklift manufacturer. OSHA also requires that the forklift data plate states rated load, capacity and attachment. The manner in which the personnel platform and the load (generator set) set share the same set of forks on the forklift as described above is not generally a practice that a forklift manufacturer approves with a sanctioned forklift data plate.

The use of the forklift also presents potential OSHA/ANSI issues. The combined weight of the platform, the load, and personnel in the platform may exceed one-half of the capacity of the forklift, which is an OSHA/ANSI violation. There is a safety concern as well in moving the forklift without proper communication with the personnel (either with an electronic communications device such as a radio, or more importantly, with line of sight communications) in the elevated platform; also an OSHA/ANSI violation.

The use of a forklift without the personnel platform, which typically requires two workers on ladders to attach the generator set while another operates the forklift, also presents safety issues. The workers on ladders, for example, perform their tasks on ladders near elevated loads. Powered equipment is used near workers on ladders. In the process of using power tools, attaching or removing bolts while on the ladder, the workers may violate the three points of contact safety rule.

The use of a forklift also raises safety issues related to the construction of the forklift itself. Forklifts are trucks with four wheels having forks that are controlled by the forklift operator to move up and down with a load mounted on the forks. As the loaded forks are moved up, the front wheels nearest the forks function as a fulcrum. The rear of the forklift (at the rear wheels of the forklift to be more precise) may have required added weight in order to counterbalance the load on the forks.

SUMMARY

In view of the above, a multi-loader is provided. In one aspect, the multi-loader includes a base comprising a cab configured to contain an operator to control the multi-loader. The base also includes an outrigger portion extending from a portion of the base supporting the cab to an end of the outrigger portion opposite the cab. The end of the base is supported by at least two wheels. A mast extends vertically from a track disposed in the outrigger portion. The mast is movably mounted on the track to move forward towards the end of the outrigger portion opposite the cab and rearward towards the cab. A pair of forks is movably mounted on the mast and configured to carry a load. A personnel platform movably is mounted on the mast and configured to support the operator. A main control panel is provided in the cab having user interface devices to control movement of the mast, movement of the platform and forks, and movement of the multi-loader. A remote control panel is mounted on the personnel platform and includes user interface devices to control movement of the mast, and movement of the carriage.

In another aspect, a multi-loader includes a base having a cab, a mast coupled to the base and moveable away from and toward the cab, and a carriage. The carriage includes a personnel platform, is coupled to the mast, and is moveable along the mast between a position proximate a surface on which the multi-loader is disposed and a position away from the surface. The multi-loader further includes a main control panel and a remote control panel. The main control panel is disposed in the cab and includes first user interface devices configured to control movement of the multi-loader, the mast relative to the base, and the carriage along the mast. The remote control panel is disposed in the personnel platform and includes second user interface devices configured to control movement of the mast relative to the base and movement of the carriage.

In yet another aspect, a method of operating a multi-loader having a base comprising a cab, a mast coupled to the base, a carriage including a personnel platform and coupled to the mast, a main control panel disposed in the cab, and a remote control panel disposed in the personnel platform includes the step of operating first user interface devices on the main control panel to control movement of the multi-loader, the mast relative to the base, and the carriage along the mast. The method also includes the step of operating second user interface devices on the remote control panel to control movement of the mast relative to the base and movement of the carriage.

DETAILED DESCRIPTION

Figure 1:
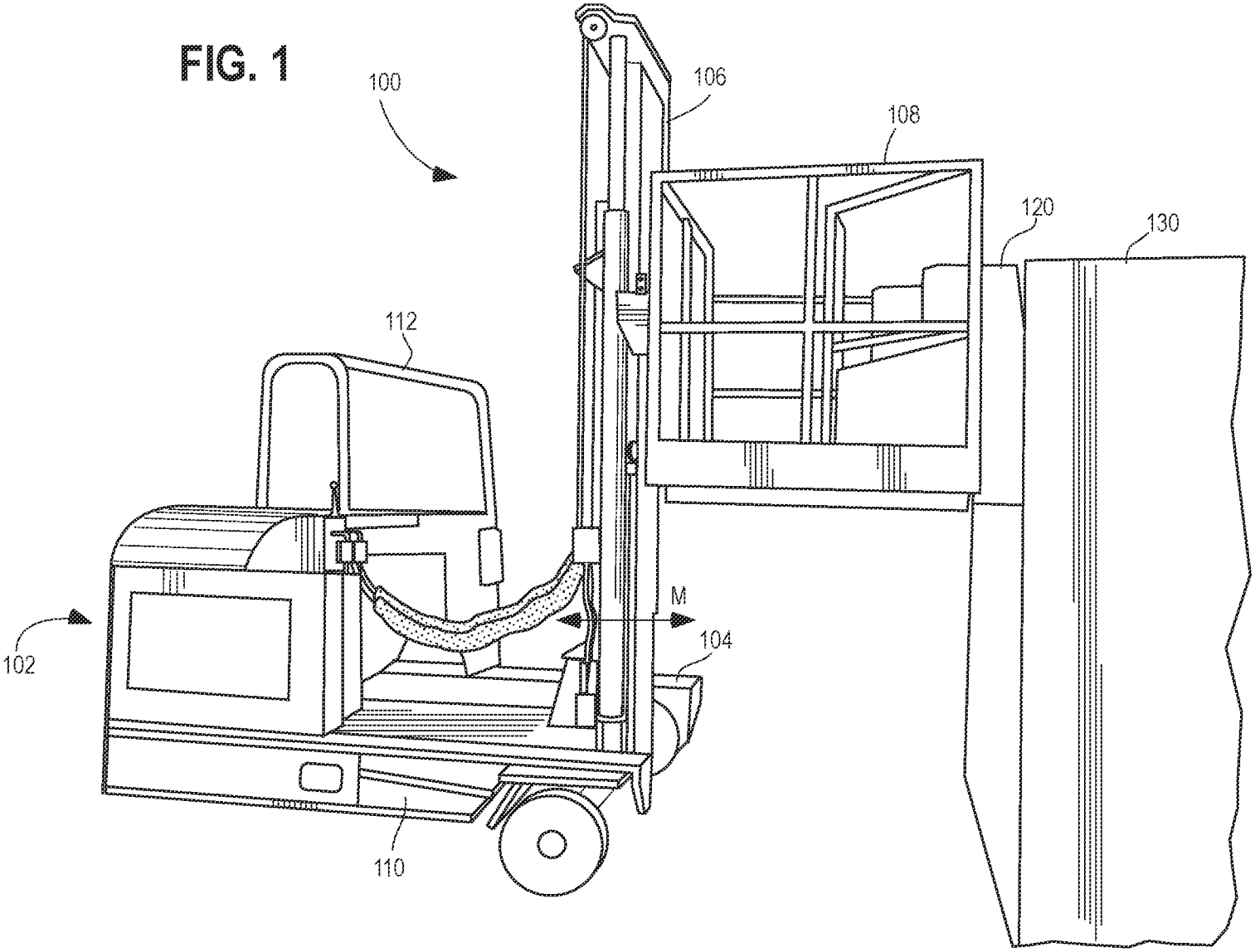
FIG. 1 is an isometric side view of a machine for handling generator sets.

Disclosed herein is an example machine for handling heavy components for attachment or detachment to or from a container. Example implementations described below are directed to a machine configured to handle a generator set for attachment to or detachment from a refrigeration unit on a shipping container. The description below is provided as an example use and is not intended to be limited to any particular application or for handling any particular components. The generator sets used to power the refrigeration units on shipping containers are typically gas-fueled motors configured to drive an electrical generator. The generator sets used in the industry have evolved into a large unit having a somewhat standard shape and can be quite heavy, particularly when filled with fuel. The generator set units are configured for attachment at an elevated position on an end of a rectangular container.

The machine or mechanism for handling generator sets described below includes a base portion having an operator cab and an outrigger portion, which includes a mast, a carriage, a pair of forks, and a personnel platform. The operator cab provides a seat, steering unit, and cab control panel to allow an operator to drive the machine and to control the mast. The outrigger portion includes a hydraulic extender attached at one end to a frame of the base and at another end to a mast mount, which supports the mast. The hydraulic extender is controlled to extend or retract the mast, which is mounted to move on a track in the outrigger portion of the truck. The outrigger portion is supported at a distal end by two front wheels. The mast extends vertically from the mast mount and supports the carriage that is movable in an upward or downward direction using a drive system, such as for example, a hydraulic drive system. The carriage supports the pair of forks and the personnel platform, where the personnel platform and forks are attached independently of one another to the carriage.

The operator is able to control the outrigger portion using controls in the cab, or using a removable control panel that the operator may carry to the personnel platform when the operator has positioned the machine for attachment or detachment of the generator set. The removable control panel may also be implemented as a remote control panel mounted on the personnel platform. The cab control panel is configured to perform all functions associated with moving the outrigger portion as well as controls for moving or driving the machine. The removable or remote control panel shall include controls for moving the lift, but shall not include controls for moving the truck as a safety feature. As used in this disclosure, the term "remote control panel" shall be understood to mean a removable or remotely mounted (on the personnel platform, for example) control panel that is secondary to the cab control panel, and is limited to controlling the lift and optionally, turning the power on or off to the machine, but shall not include controls for moving the machine.

The machine may be used to attach or detach a generator set to or from a refrigeration unit on a shipping container by a single worker. In attaching the generator set, the operator drives the machine to a generator set and uses the forks on the machine to lift the generator set. The operator then drives the generator set to an end of the container on which the generator set is to be attached. As noted above, the outrigger portion includes a track on which the mast travels in response to commands to extend or retract. The operator then controls the mast to extend towards the container end. The operator may then enter the personnel platform and use the remote control panel to lift the generator set on the forks to the level of attachment on the container. The operator removes a key from the cab to operate the remote and vice versa, meaning the operation can only be controlled from only one position at a time. The remote control panel includes fine positioning controls for moving the generator set closer to the container or from side-to-side so that the generator set is aligned properly with the points of attachment on the container. The operator may then attach the generator set to the container. The operator may then use the remote control panel to retract the forks from under the now attached generator set, and to lower the personnel platform back to a low level to permit the operator to dismount. The operator may then re-enter the cab of the truck and use the key to transfer control back to the cab to position the forks to a drive position (such as by fully retracting the mast to the retracted position on the truck), to retract the outrigger portion on the front wheels, and to drive the machine back to the next task.

The generator set may be detached by a single worker, the user, driving the machine to the end of the container on which the generator set is mounted. The operator may then mount the personnel platform and use the key or similar lock-out device to transfer control from the cab to the remote control panel so that the operator has exclusive control of the machine movements. The operator can fine tune the position of the personnel platform using the remote control panel so that the forks are under the generator set and the operator can detach the generator set from the container. Further fine tuning of the position using the remote control panel allows the user to ensure the generator set is supported by the forks before complete detachment is achieved. When the generator set is detached, the user controls the mast to retract along its base track and then to lower the generator set on the forks to a safe dismount level. Once lowered, the user dismounts the personnel platform and uses the key or similar lock out device to transfer control back to the cab control panel to drive the machine.

In an example implementation, the machine is rated for a load of 12,000 lbs. at 24 load center, which is proper for handling the heaviest known generator sets based on 50% de-rating per OSHA standards ANSI/ITSD56.1. Standard ANSI/ITSD56.1 is incorporated by reference herein.

FIG. 1 is an isometric front view of a machine 100 for handling a generator set 120. The machine 100 in FIG. 1 is in a lifted and extended position. The machine 100 in FIG. 1 includes a base 102 having an outrigger portion, which supports a mast 106. The mast 106 is mounted on a track in the outrigger portion 104 to permit motion of the mast 106 along the path indicated by the double arrow, M. The mast 106 supports a carriage, which holds a personnel platform 108, and a pair of forks (described with reference to FIGS. 2A-3B below). The personnel platform is configured to support an operator as shown in FIG. 1 in a space that allows the operator to work on the generator set attachment or detachment to a shipping container 130. The operator is able to control the position of the personnel platform and forks with the generator set load using a remote control panel 109.

The base 102 includes a cab 112 having a full cab control panel to allow the operator to control the position of the mast 106 and forks as well as to drive the base 102. The base portion 102 of the truck is supported by two front wheels 110 and a rear wheel and/or a set of rear wheels (not visible in FIG. 1).

Figure 2A:
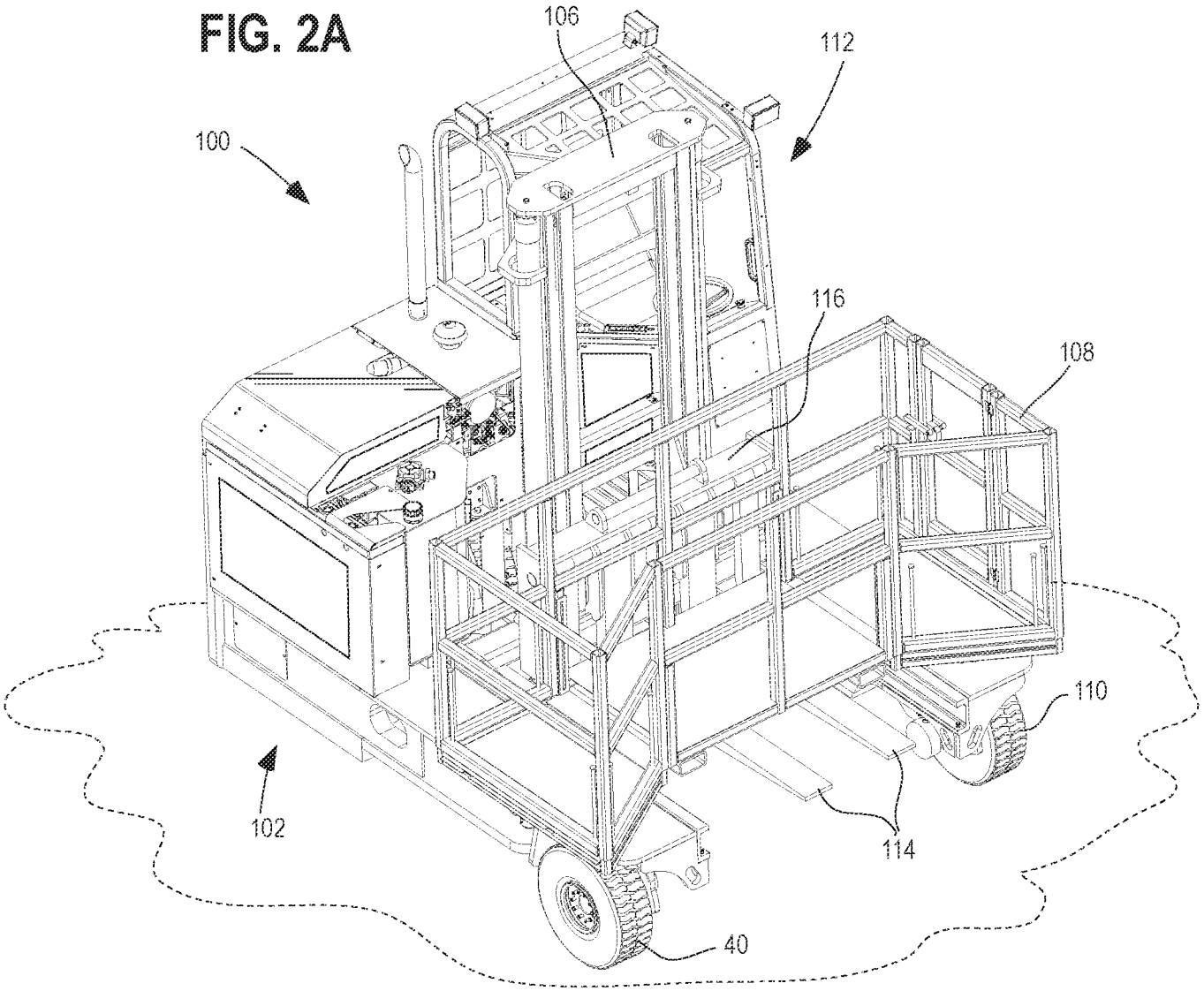
FIG. 2A is a front isometric view of the machine with the mast in a retracted position.
Figure 2B:
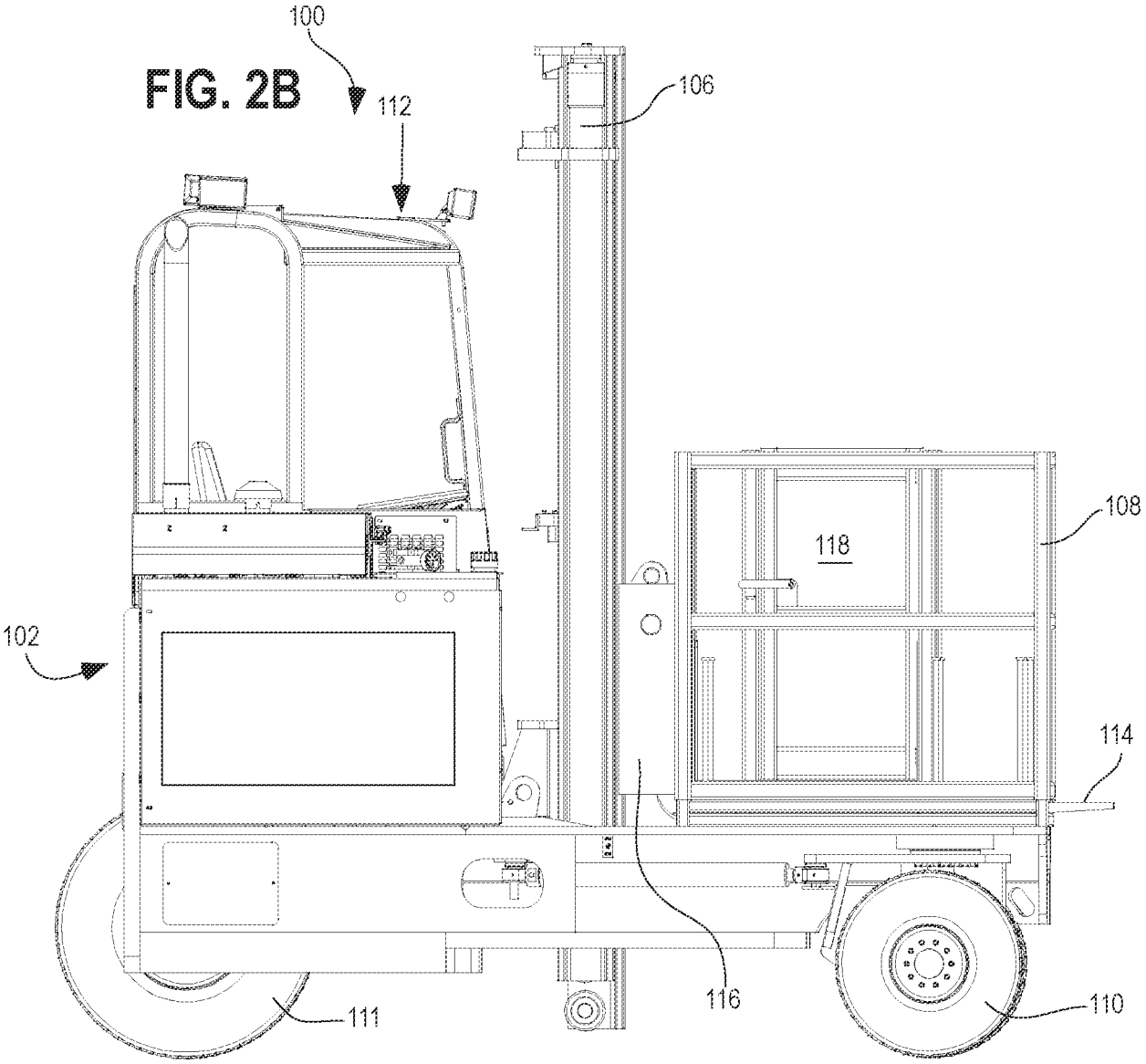
FIG. 2B is a side view of the machine with the mast in a retracted position.

FIG. 2A is a front isometric view of the machine 100 with the mast 106 in a retracted position. FIG. 2B is a side view of the machine 100 with the mast 106 in a retracted position. The machine 100 in FIGS. 2A and 2B is not loaded thereby exposing a pair of forks 114 on which the generator set is mounted during attachment. The machine 100 is typically driven with the mast 106 in the retracted position whether the forks 114 are loaded with a generator set or not. The carriage 116 is mounted on the mast 106 and configured to move up or down on the mast 106 in response to control signals triggered by the operator using the remote control panel or the cab control panel. The personnel platform 108 and the forks 114 are mounted on the carriage 116 by independent attachment to the carriage 116. That is, the personnel platform 108 supports the weight of the operator or any other load on the personnel platform 108, but does not support any of the load on the forks 114. The forks 114 support the load on the forks 114, such as a generator set that has been mounted on the forks 114, but does not support any of the load in the personnel platform 108. The personnel platform 108 includes a gate 118 to permit entry and exit to and from the personnel platform 108.

The base 102 supports the cab 112 and includes two front wheels 110 and a single rear wheel 111 (shown in FIG. 2B). The base 102 may include more wheels, for example, two wheels may be attached to the rear portion of the base 102. The number of wheels used may depend on the desired manoeuvrability of the base 102 and the wheelbase desired for supporting the loads to be handled by the base 102.

Figure 3A:
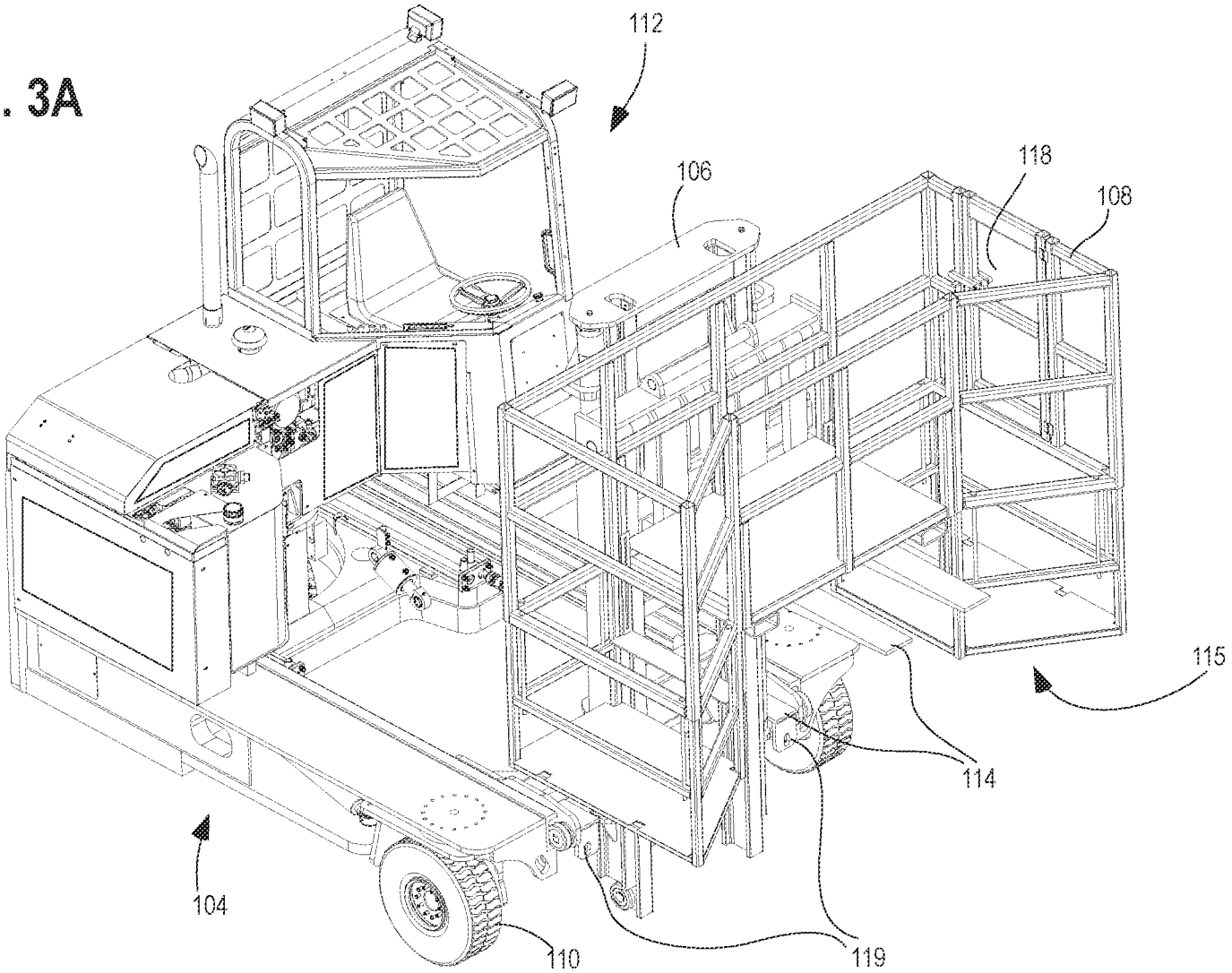
FIG. 3A is a front isometric view of the machine with the mast in an extended position.
Figure 3B:
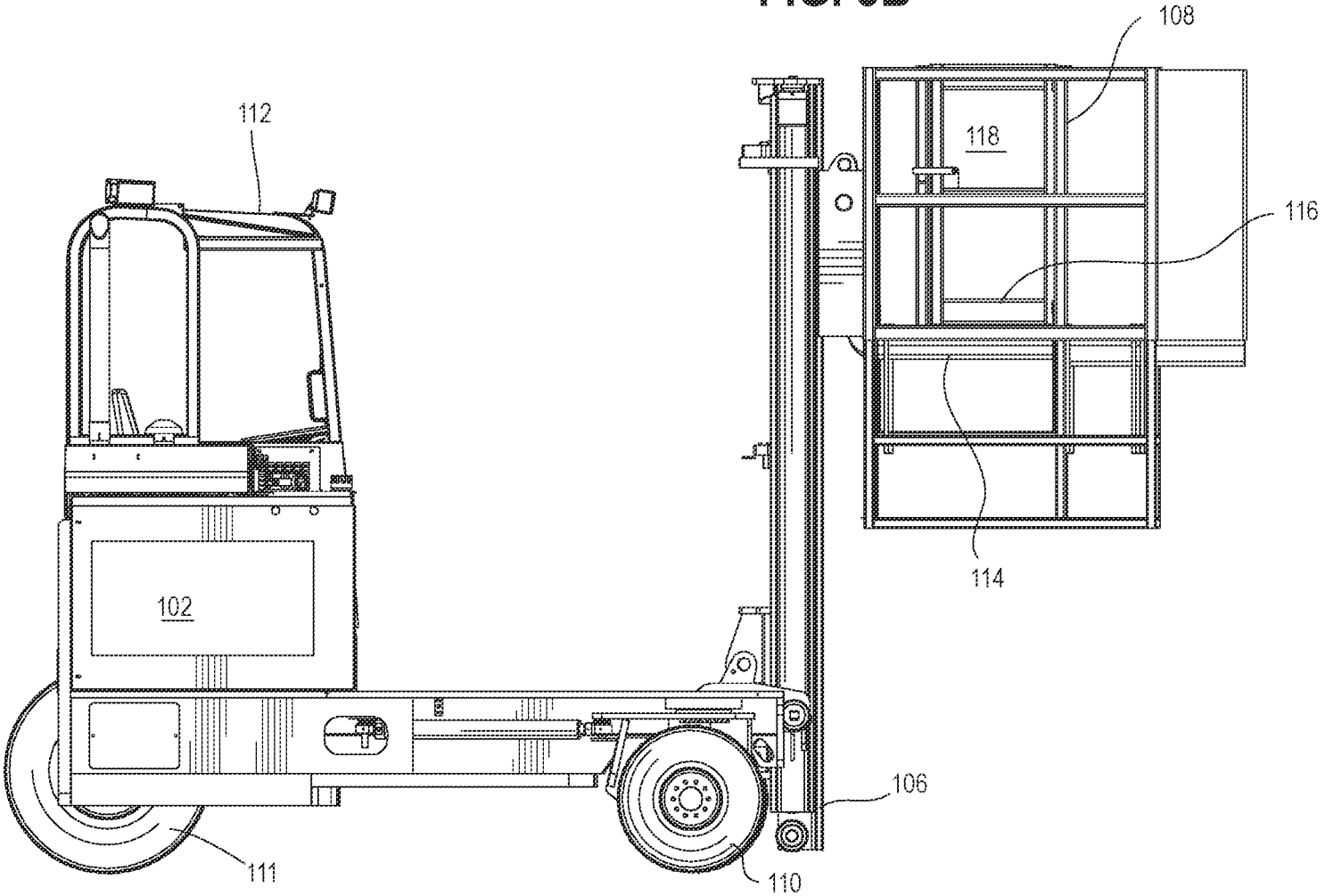
FIG. 3B is a side view of the machine with the mast in an extended position.

FIG. 3A is a front isometric view of the machine 100 with the mast 106 in an extended position. FIG. 3B is a side view of the machine 100 with the mast 106 in an extended position. The mast 106 may be mounted on a track 119 at the base of the outrigger portion 104 of the machine 100. The track 119 may be implemented, in one example implementation, as a pair of toothed rails configured to support a corresponding pair of toothed wheels, or gears connected by an axle configured to support the mast 106. The mast 106 may be further connected to a hydraulic drive configured to push or pull the mast 106 along the pair of rails. The pair of rails having wheels mounted thereon is one example of a track for extending and retracting the mast 106. The mast 106 may be moved along the base of the outrigger portion 104 using any other suitable system for moving heavy loads in a linear motion.

It is noted that as the mast 106 is extended or retracted, the mast 106 remains between the front wheels 110 and the rear wheel 111 for most, or all, of the extent of travel of the mast 106. In one example implementation, the mast 106 may remain between the front wheels 110 and the rear wheel 111 for as much as 75% of the extent of travel of the mast 106 along its track. By remaining between the front wheels 110 and the rear wheel 111, the load on the mast 106 may be moved up and down without applying a leverage that converts the front wheels 110 to a fulcrum as is the case with forklifts. The base 102 need not be provided with a counterweight to balance the load on the mast 106 as the load is moved upward. Even when at its fullest extended position, the mast 106 may rely on the full extent of the wheelbase of the base 102 to counterbalance a load at its highest level as shown in FIG. 3B.

As shown in FIGS. 2A, 2B, 3A, and 3B, the carriage 116 is attached to the mast 106 in a manner that permits an operator to move the carriage 116 up or down along the mast 106. The personnel platform 108 and the forks 114 are independently attached to the carriage 116 and move up and down with the carriage 116. The carriage 116 (and personnel platform 108 and forks 114) may be moved with the mast 106 when the mast 106 is extended (out towards the front wheels 110) or retracted (in towards the base 102). The remote control panel (described in more detail with reference to FIG. 4) and the cab control panel include controls, such as for example, lever switches or buttons or dial switches or other suitable switch mechanism configured to extend or retract the mast 106, and with it, the carriage 116, personnel platform 108 and forks 114 when actuated by the operator. The carriage 116 may also be mounted on the mast 106 with a mechanism for moving laterally (a function known as side shifting). A switch (such as for example, a lever switch or button or dial switch or other suitable switch mechanism) may be mounted on the remote control panel and the cab control panel to allow the user to move the carriage 116 to the right side or to the left side.

When controlled to move sideways, right or left, the carriage 116 may be moved using a hydraulic cylinder in the indicated direction along a channel or a track extending across opposite sides of the mast 106. The carriage 116 may include a roller, wheel, or channel member suitably formed to fit within the channel allowing the carriage 116 to move in only a sideways (right or left) direction.

As noted above, the personnel platform 108 is mounted and supported by the carriage 116 and configured to move up and down or side to side when the carriage 116 is controlled to move by the operator. The personnel platform 108 is mounted on the carriage 116 independent of the forks 114. It is noted that the personnel platform 108 in FIGS. 2A and 3A is formed to match a contour of a typical generator set on a front side 115, which is the side of the personnel platform 108 that receives the generator set when the operator is in position to perform tasks on the generator set. The form of the front side 115 is generally curved to substantially match a curve around the generator set allowing an installer in the personnel platform 108 to more easily reach any part of the generator set. As noted above, examples of implementations of the machine 100 may be configured to handle other types of heavy components in other environments and the shape of the opening 115 of the personnel platform 108 is one modification that can be made for other applications.

The forks 114 may be mounted on one or two channels, or tracks, affixed to the carriage 116 in a forward and backward direction. A hydraulic drive may be controlled by one or more switches on the cab control panel or the remote control panel to move the forks 114 in or out, or forward or backward.

Figure 4:
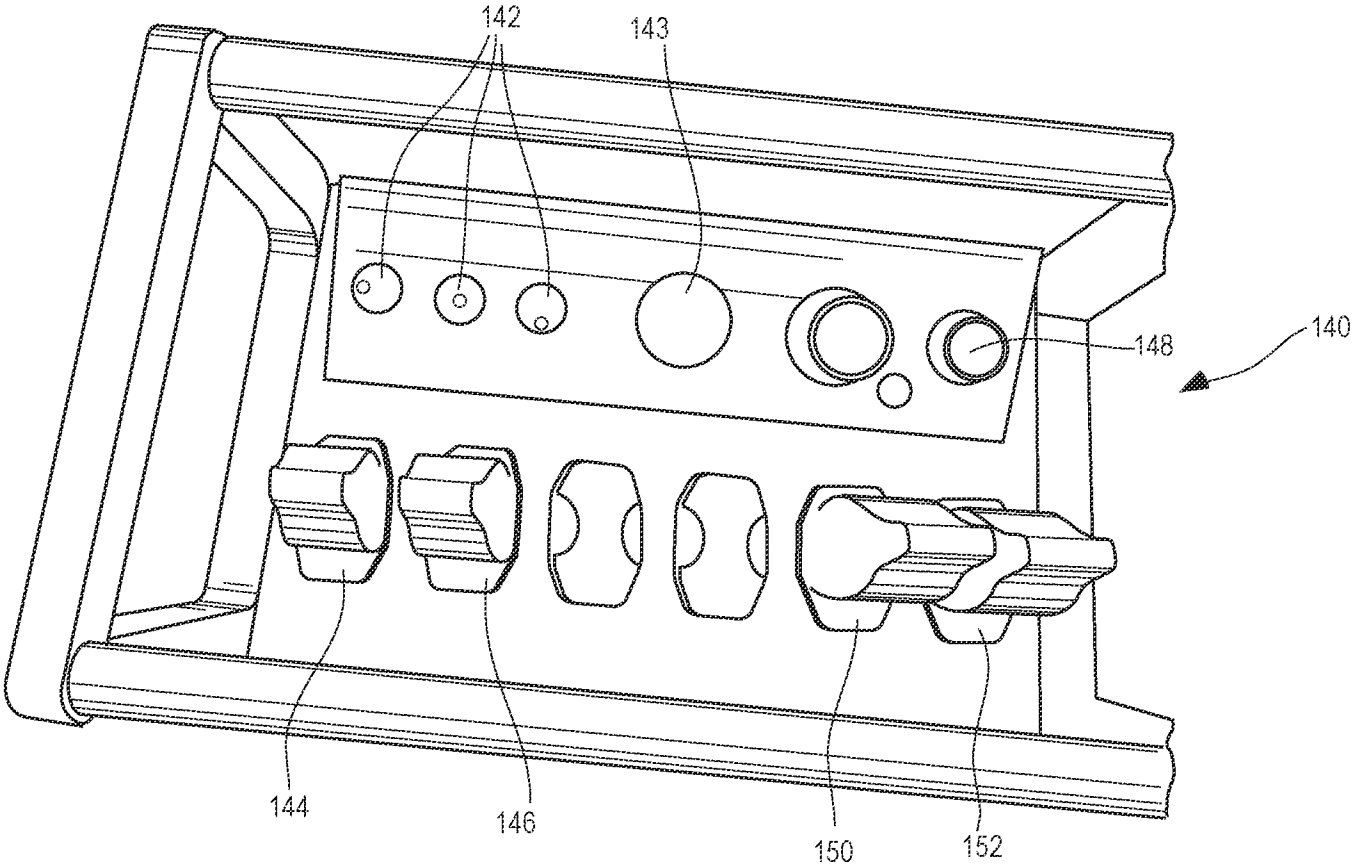
FIG. 4 is a top view of a personnel platform control panel.

FIG. 4 is a top view of a remote control panel 140. The remote control panel 140 in FIG. 4 includes the following control elements:

1. Take Control Button 149
2. Start Engine Button 148
3. Emergency stop 143
4. Lift up/down 144
5. Extend/Retract 146
6. Forks in/out 150
7. Side shift left/right 152

As noted above, the remote control panel 140 may be affixed to a part of the personnel platform. When the operator has moved to the personnel platform from the cab, the operator may actuate the "Take Control Button" 149 to disable the control panel in the cab and transfer control to the remote control panel 140. The remote control panel 140 provides the operator with functions for raising the load on the forks, or raising the forks to position the forks at the load. The remote control panel 140 includes functions that would allow the operator to adjust the position of the forks relative to the container without having to be in the cab. Whether the generator set is being attached or detached, the operator is able to perform any task at the generator set from the personnel platform without the assistance of any other workers on ladders or on the ground below the generator set.

It is noted that the remote control panel 140 need not include any controls for driving the truck from the personnel platform. In one example implementation, at a minimum, all drive functions are disabled when the carriage is at an elevated position for safety reasons. In another example implementation, the remote control panel 140 includes user interface devices for driving the multi-loader. In another example implementation, the functions for driving the multi-loader using the remote control panel 140 are enabled only when the personnel platform is in a fully-lowered position.

Figure 5:
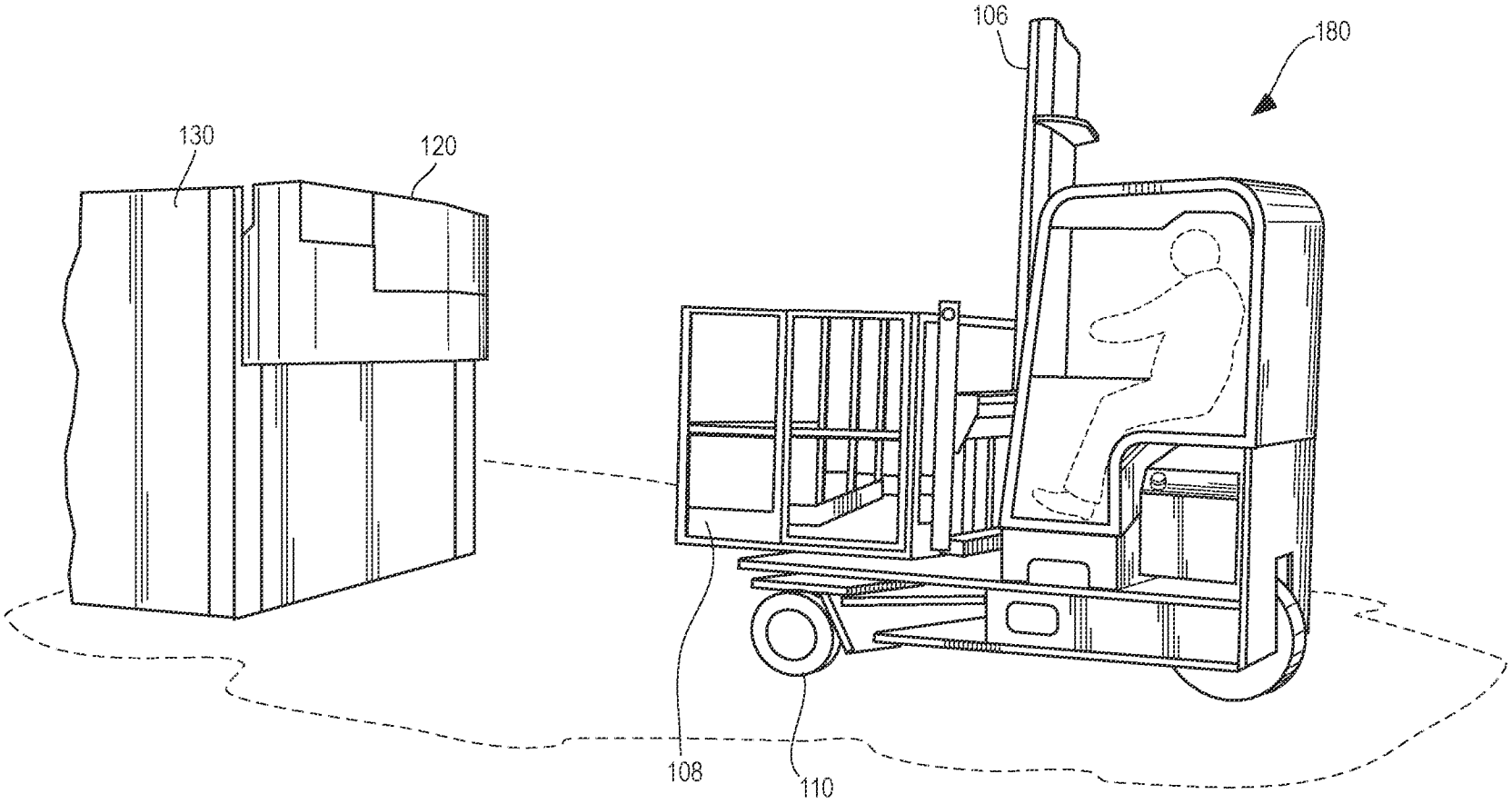
FIG. 5 shows a machine approaching a generator set mounted on a container.

Example implementations of a machine for handling heavy components, such as a generator set, advantageously allows a single operator to drive the machine with or without a load, and to control the positioning of the forks allowing the operator to perform tasks on the generator set in position for attachment or detachment from the personnel platform, without the need of assistance from any other worker. FIGS. 5-8 illustrate steps for detaching a generator set 120 from a container 130 by a single worker, employee O. FIG. 5 shows an operator O driving the machine 100 and approaching the generator set 120 mounted on the container 130. The operator is approaching the container 130 with the mast 106 in retracted position. The operator may approach the container 130 and stop so that, for example, the front wheels 110 directly underneath the personnel platform 108 in retracted position are just behind the generator set.

Figure 6:
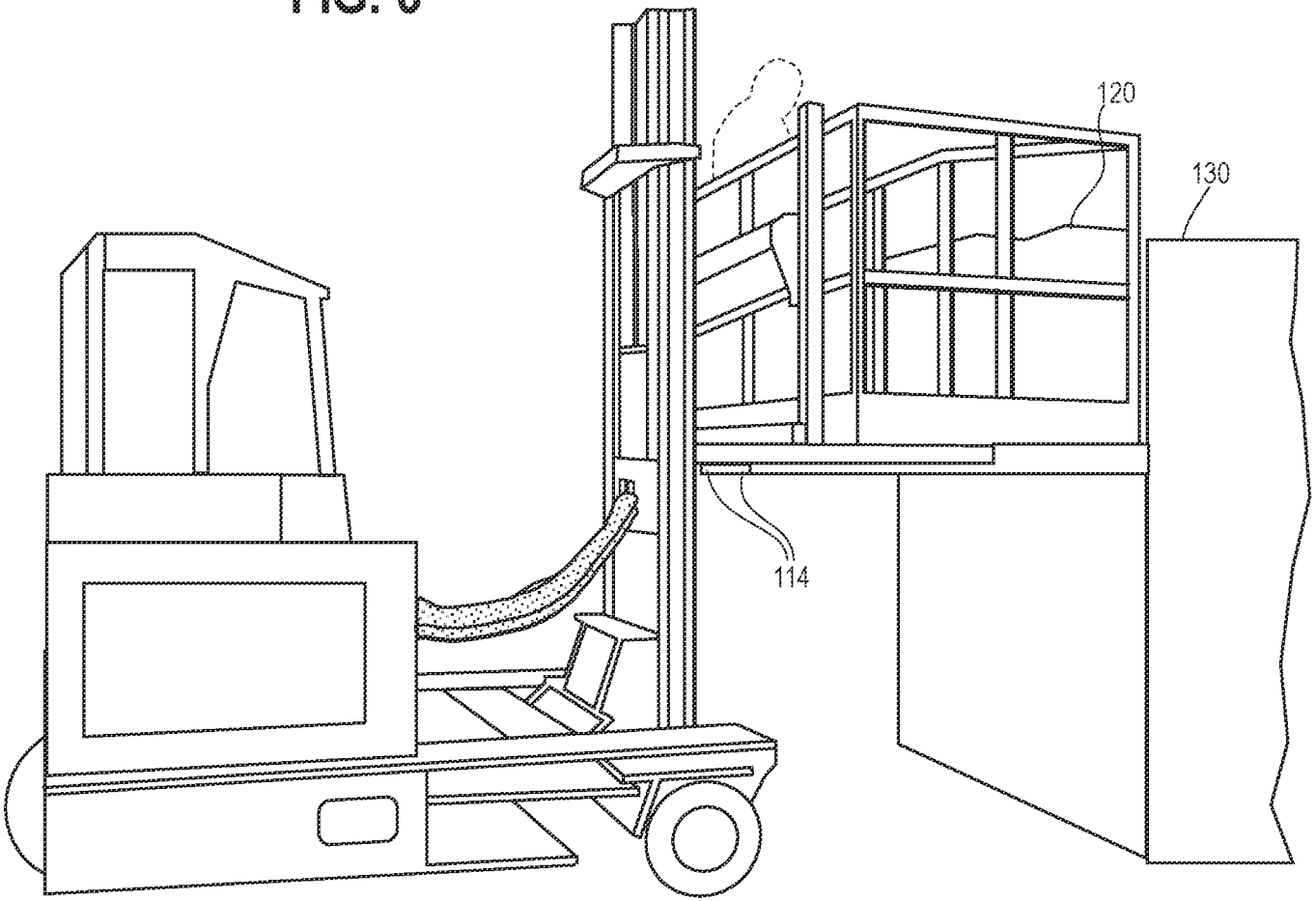
FIG. 6 shows an operator in the personnel platform while raised even with the generator set on the container.

FIG. 6 shows the personnel platform 108 raised to a level even with the generator set 120 with the operator in the personnel platform 108. The operator in the personnel platform 108 is at the remote control panel, which is not visible in FIG. 6, and is able to first actuate the control on the remote control panel to take control of the lift. In taking control of the lift, the cab control panel may be disabled completely. The operator may then actuate a control on the remote control panel to raise the personnel platform and generator set.

The position of the operator and the remote control panel provides the operator with a vantage point from which the operator is able to view the position of the personnel platform 108, and therefore, the forks 114 relative to the generator set 120. The operator is also able to use the controls on the remote control panel to extend and shift the forks 114 toward the generator set 120 to ensure the center of gravity of the generator set 120 is above and between the forks 114. When the operator has properly positioned the forks 114 to support the weight of the generator set 120 when it is detached, the operator may leave the remote control panel to perform the tasks of detaching the generator set 120 from the container 130. Typically, the generator sets 120 are attached using multiple bolts, all of which will be accessible to the operator from the personnel platform 120.

Figure 7:
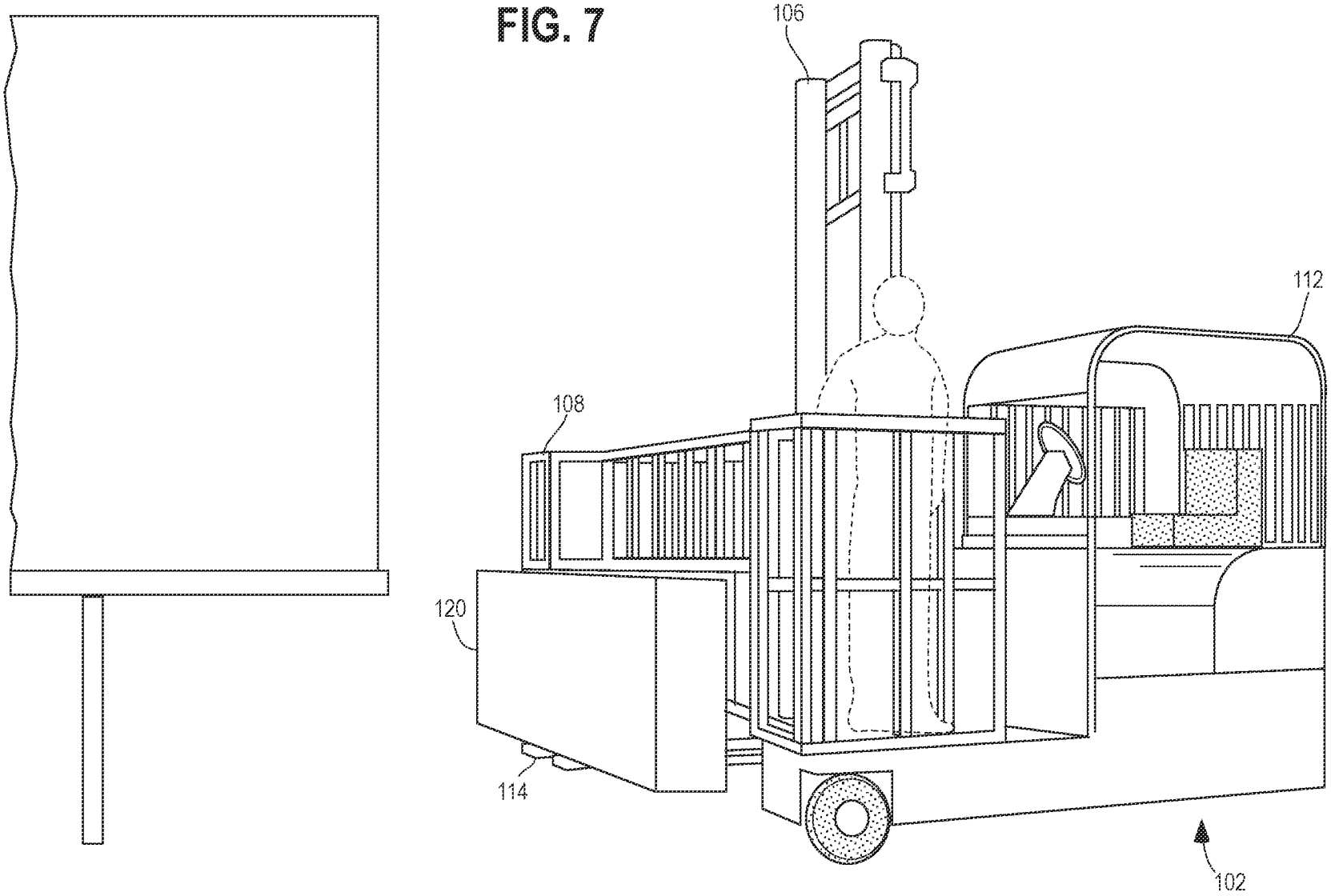
FIG. 7 shows the machine loaded with the generator set in a lowered, retracted position.

FIG. 7 shows the machine 100 detached from the container 130 and the generator set 120 loaded on the forks of the machine with the mast 106 in a retracted position. The operator is able to control the personnel platform 108 and forks 114 using the remote control panel. First, the operator lowers the forks 114 and personnel platform 108. Then, the operator retracts the mast 106 using the controls on the remote control panel. The operator may then dismount from the personnel platform 108.

Figure 8:
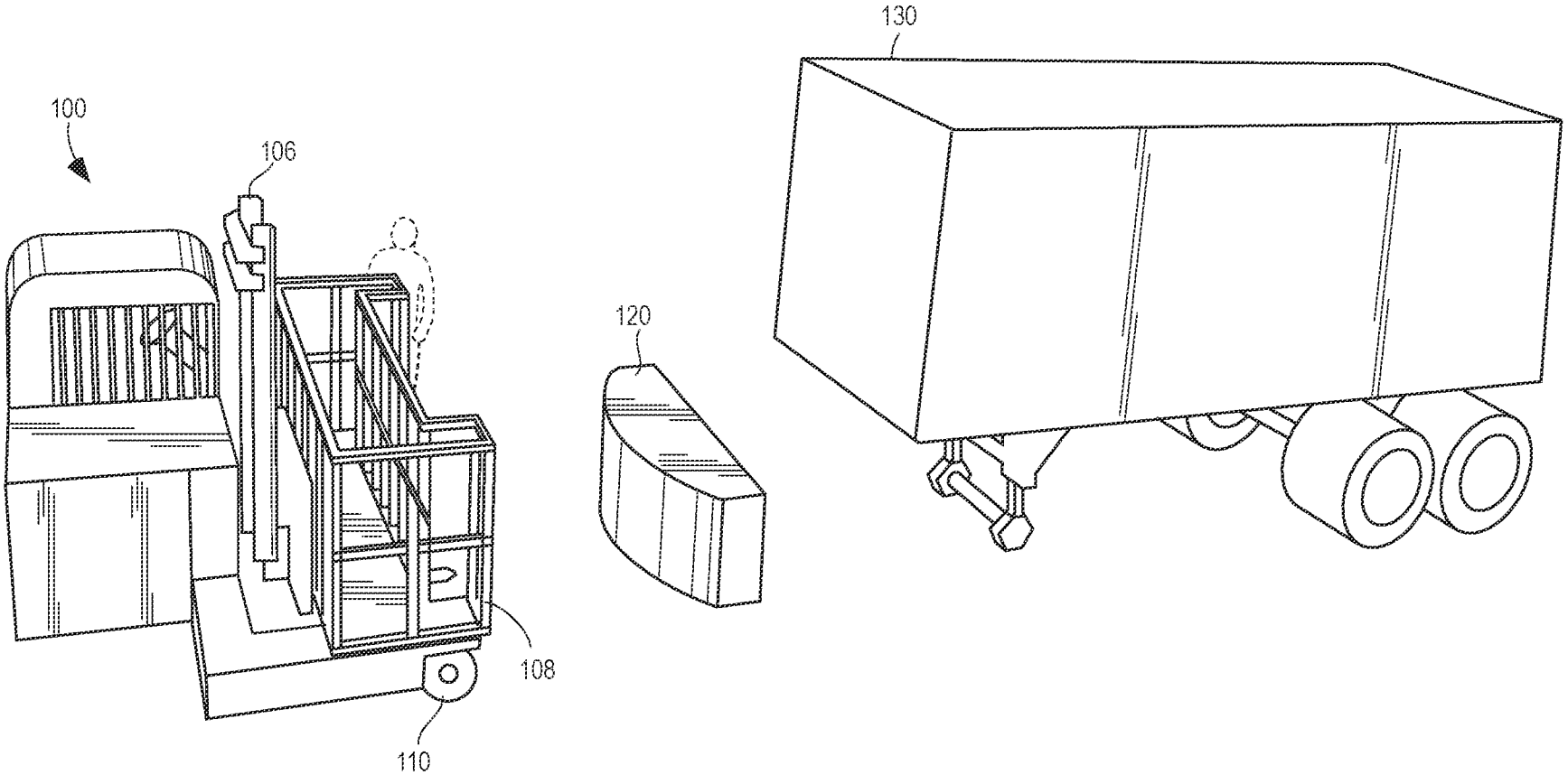
FIG. 8 shows the machine next to the generator set, operator and container.

The operator may then re-enter the cab 112 of the base 102 to take control from the remote control panel and reset the control back to the cab control panel. From the cab, the operator may operate the machine 100 in a manner similar to a forklift to set the generator set 120 down, preferably in a place of storage. FIG. 8 shows the machine 100, the detached generator set 120, the operator and the container 130 after performing an operation by a single worker.

The process of attaching the generator set 120 would be a reverse of the process described with reference to FIGS. 5-8 for detaching the generator set 120.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure. Numerous modifications to the present disclosure will be apparent to those skilled in the art in view of the foregoing description. It should be understood that the illustrated embodiments are exemplary only, and should not be taken as limiting the scope of the disclosure.

What is claimed is:

1. A multi-loader comprising:

a base comprising a cab configured to contain an operator to control the multi-loader and an outrigger portion of the base extending from a portion of the base supporting the cab to an end of the outrigger portion opposite the cab, wherein the end is supported by at least two wheels;

a mast extending vertically from a track disposed in the outrigger portion, where the mast is movably mounted on the track to move forward towards the end of the outrigger portion opposite the cab and rearward towards the cab;

a pair of forks movably mounted on the mast and configured to carry a load;

a personnel platform movably mounted on the mast and configured to support the operator;

a main control panel in the cab comprising user interface devices to control movement of the mast, movement of the platform and forks, and movement of the multi-loader; and a remote control panel mounted on the personnel platform comprising user interface devices to control movement of the mast, and movement of the personnel platform.

2. The multi-loader of claim 1, wherein the main control panel includes a locking device to disable operation of the main control panel when the operator operates the multi-loader using the remote control panel.

3. The multi-loader of claim 2, wherein the locking device is a key that enables operation of the main control panel and the remote control panel.

4. The multi-loader of claim 1, wherein the movability of the multi-loader is disabled when the operator operates the multi-loader using the remote control panel.

5. The multi-loader of claim 1, wherein the remote control panel includes a user interface device to control movement of the multi-loader.

6. The multi-loader of claim 5, wherein the movement of the multi-loader is disabled when the personnel platform is not in a low position.

7. The multi-loader of claim 1, wherein the carriage is mounted in a lateral track within the mast and wherein the carriage is configured to move laterally.

8. The multi-loader of claim 1, wherein the personnel platform extends laterally in a shape conforming to a generator set to provide the operator access to attaching components used to attach and detach the generator set to a shipping container.

9. The multi-loader of claim 1, wherein the personnel platform includes a railing on a perimeter of the personnel platform.

10. The multi-loader of claim 9, wherein the personnel platform includes a gate to permit entry by an operator.

11. The multi-loader of claim 1, further comprising a carriage movably mounted on the mast to move vertically, the carriage configured to support the forks.

12. The multi-loader of claim 11, where the carriage is configured to support the personnel platform.

13. A multi-loader comprising:

a base comprising a cab;

a mast coupled to the base and moveable away from and toward the cab;

a carriage comprising a personnel platform configured to support an operator and forks configured to support a load, coupled to the mast, and moveable along the mast between a position proximate a surface on which the multi-loader is disposed and a position away from the surface;

a main control panel disposed in the cab comprising first user interface devices configured to control movement of the multi-loader, the mast relative to the base, and the carriage along the mast; and a remote control panel disposed in the personnel platform comprising second user interface devices configured to control movement of the mast relative to the base and movement of the carriage.

14. The multi-loader of claim 13, wherein the main control panel includes a locking device that prevents simultaneous use of the first user interface devices and second user interface devices to control movement of the mast or the carriage.

15. The multi-loader of claim 13, wherein one of the second user devices is configured to control movement of the multi-loader along the surface.

16. The multi-loader of claim 13, wherein the forks move with the carriage, the personnel platform extends laterally in a shape conforming to the load disposed on the forks and the personnel platform is configured to provide an operator access to attaching components used to attach and detach the to a shipping container.

17. A method of operating a multi-loader, wherein the multi-loader includes a base comprising a cab, a mast coupled to the base, a carriage including a personnel platform configured to support an operator and forks configured to support a load and coupled to the mast, a main control panel disposed in the cab, and a remote control panel disposed in the personnel platform, comprising the steps of:

operating first user interface devices on the main control panel to control movement of the multi-loader, the mast relative to the base, and the carriage along the mast; and operating second user interface devices on the remote control panel to control movement of the mast relative to the base and movement of the carriage.

18. The method of claim 17, further including actuating one of the second user interface devices to disable control of movement of the multi-loader, the mast, and the carriage using the first user interface devices.

19. The method of claim 17, further including operating at least one of the second user interface devices to control movement of the multi-loader along a surface on which the multi-loader is disposed.

20. The method of claim 19, wherein the load is a generator set, further including moving forks with the carriage, extending the personnel platform laterally in a shape conforming to a generator set disposed on the forks, and providing an operator access to attaching components used to attach and detach the generator set to a shipping container.

* * * * *